United States Patent [19]

Yee et al.

[11] Patent Number: 5,008,499

[45] Date of Patent: Apr. 16, 1991

[54] BI-STABLE INTERLOCK ARRANGEMENT FOR MOLDED CASE CIRCUIT BREAKERS

[75] Inventors: Edgar Yee, Vernon; Richard E. Bernier, Southington, both of Conn.

[73] Assignee: General Electric Company, New York, N.Y.

[21] Appl. No.: 569,897

[22] Filed: Aug. 20, 1990

[51] Int. Cl.[5] ..... H01H 9/26
[52] U.S. Cl. ..... 200/50 C
[58] Field of Search ..... 200/5 B, 5 E, 5 EA, 200/5 EB, 50 C, 330

[56] References Cited

U.S. PATENT DOCUMENTS 4,754,247 6/1988 Raymont et al. ..... 335/202
4,924,041 5/1990 Yee ..... 200/50 C

*Primary Examiner*—J. R. Scott
*Attorney, Agent, or Firm*—Richard A. Menelly; Walter C. Bernkopf; Fred Jacob

[57] ABSTRACT

A bi-stable interlock arrangement allows two circuit interruption devices such as electric circuit breakers and electric disconnect switches to be interlocked such that only one such device can be turned ON at one time. The interlock is used with main and auxiliary power sources to ensure that only one source of electrical power is activated at one time.

10 Claims, 4 Drawing Sheets

BI-STABLE INTERLOCK ARRANGEMENT FOR MOLDED CASE CIRCUIT BREAKERS

BACKGROUND OF THE INVENTION

The invention relates to an interlock arrangement whereby one circuit interruption device such as a molded case circuit breaker or electric disconnect switch can be operated at one time. In a motor control cabinet whereby a plurality of circuit breakers are remotely driven by electrical motor operators, it is difficult to ensure that only one such circuit breaker or switch will be energized at one time. This is especially important when one such circuit breaker connects with a source of electricity from a utility supplier and the other connects with an auxiliary or emergency power source. Energization of two separate sources of power can seriously damage electrical equipment connected within the associated electrical power distribution system.

U.S. Pat. No. 4,924,041 entitled "Universal Circuit Breaker Interlock Arrangement" provides excellent interlock function between circuit breakers that are rated in excess of 250 ampere continuous current. With lower-rated circuit breakers such as those described within U.S. Pat. No. 4,754,247 which incorporates auxiliary apparatus within the circuit breaker cover, the compact circuit breaker operating mechanism responds rapidly to turn the circuit breaker contacts ON and OFF with a very short distance of travel of the circuit breaker operating handle. When the interlock arrangement, described within the aforementioned U.S. Pat. No. 4,924,041 is used with such smaller ampere-rated circuit breakers, it is possible to "tease" one circuit breaker to its ON position while the other circuit breaker is also in its ON position. Such an interlock arrangement for lower ampere-rated circuit breakers is preferably limited to manual operation since an operator can observe both handles within the interlock arrangement to insure that one of the handles remains OFF when the other handle is turned ON. With remotely controlled electric motor operators such as those described within the aforementioned U.S. Pat. No. 4,924,041, the movement of one handle of the interlock device to its ON position can cause the circuit breaker operating mechanism to rapidly switch the circuit breaker to its ON position before the other circuit breaker has fully turned to its OFF position because of the abbreviated handle stroke, as described earlier.

One purpose of the instant invention accordingly is to provide a circuit breaker interlock arrangement for lower industrial-rated circuit breakers whereby both of the interlock circuit breakers can be turned OFF at any time while only one of the interlocked circuit breakers can be turned ON at any one time.

SUMMARY OF THE INVENTION

A bi-stable latch interlock arrangement for circuit interruption devices such as circuit breakers and disconnect switches is provided by means of a pair of interlock cams that interact with a bi-stable latch whereby one interlock cam is locked in the OFF position until the other interlock cam drives the bi-stable latch to unlatch the other interlock cam. The bi-stable latch interaction with the interlock cams assures that only one circuit breaker or switch can be turned ON at any one time.

DESCRIPTION OF THE PREFERRED EMBODIMENT

Figure 1:
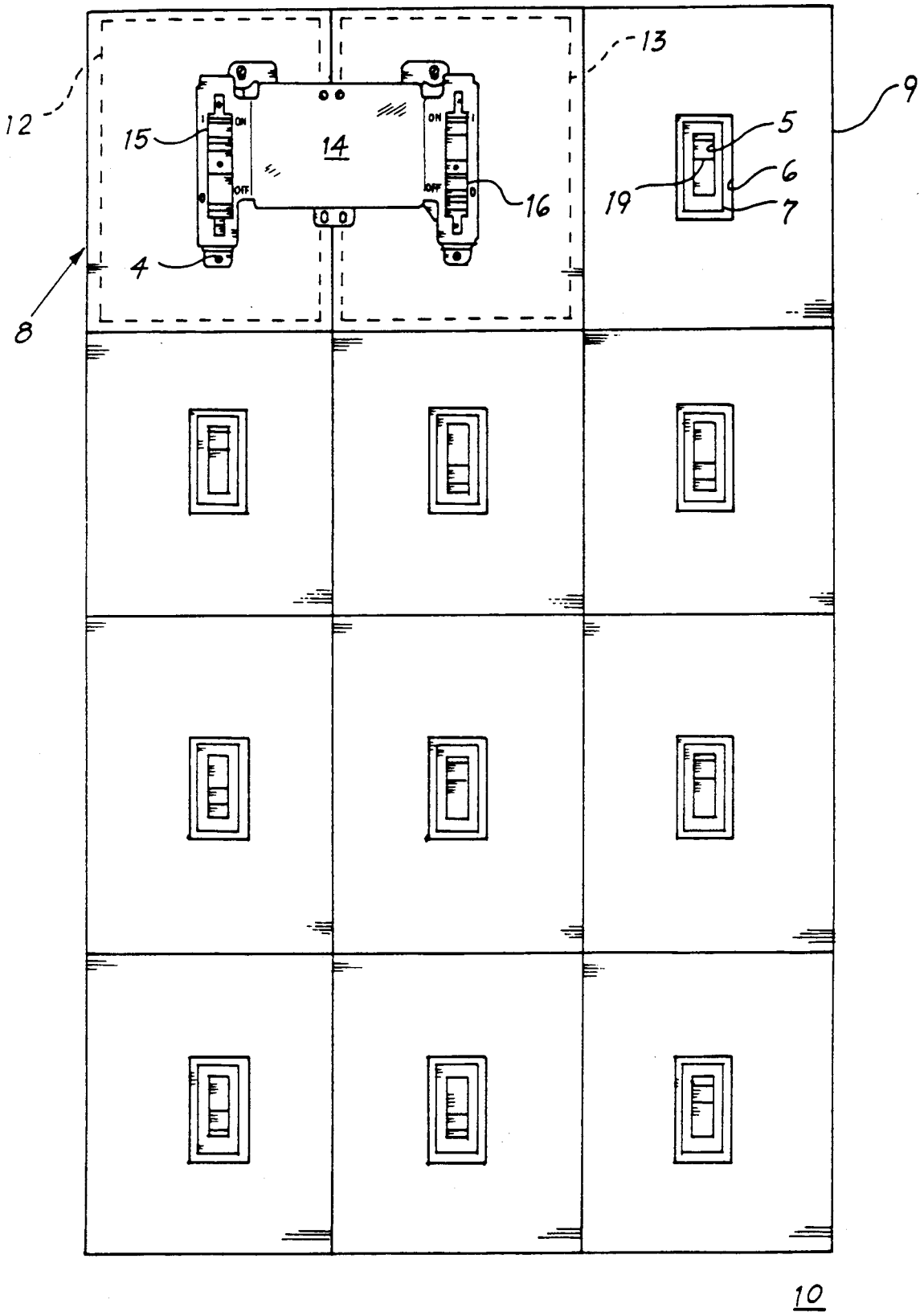
FIG. 1 is a front plan view of a circuit breaker enclosure including the bi-stable interlock arrangement in accordance with the invention.

A circuit breaker enclosure 10 is shown in FIG. 1 wherein a first circuit breaker 12 connecting with a main source of power is interlocked with a second circuit breaker 13 connecting with an auxiliary source of power by means of a bi-stable interlock device 14 that is attached to the front wall 9 of the enclosure by means of screws 4. The enclosure includes several compartments 8 each of which include a slot 6 through which a circuit breaker escutcheon 7 extends to allow the circuit breaker operating handle 19 within the handle slot 5 to be accessible external to the compartment. The bi-stable interlock device includes a pair of interlock handles 15, 16 associated with the corresponding circuit breakers 12, 13 to ensure that only one circuit breaker handle can be turned to the ON position at any one time.

Figure 2:
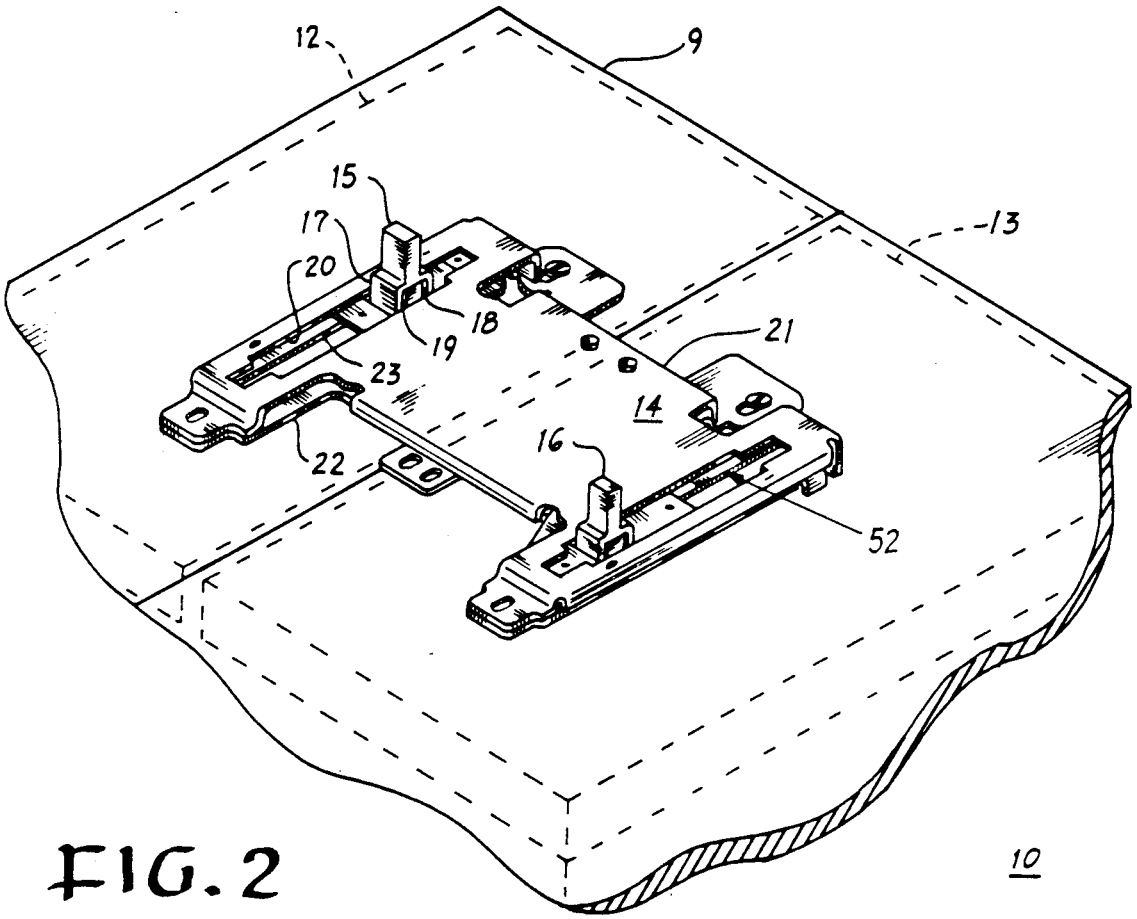
FIG. 2 is an enlarged front perspective view of a part of the circuit breaker enclosure of FIG. 1.

The arrangement of the circuit breakers 12, 13 relative to the bi-stable interlock device 14 hereafter "interlock" is shown in FIG. 2 where the front wall 9 of the enclosure 10 is partially removed. The interlock 14 is arranged such that the planar cover 21 extending along the top of the interlock interfaces with a corresponding planar base 22 to form a track 52 defined between the elongated slot 20 in the cover 21 and the corresponding elongated slot 23 in the base 22. The track allows the interlock handles 15, 16 to move back and forth smoothly within the slots. The operating handles 19 of the circuit breakers 12, 13 are trapped beneath the U-shaped openings 18 defined within the U-shaped posts 17 to correspondingly move the circuit breaker operating handles in unison with the interlock handles.

Figure 3:
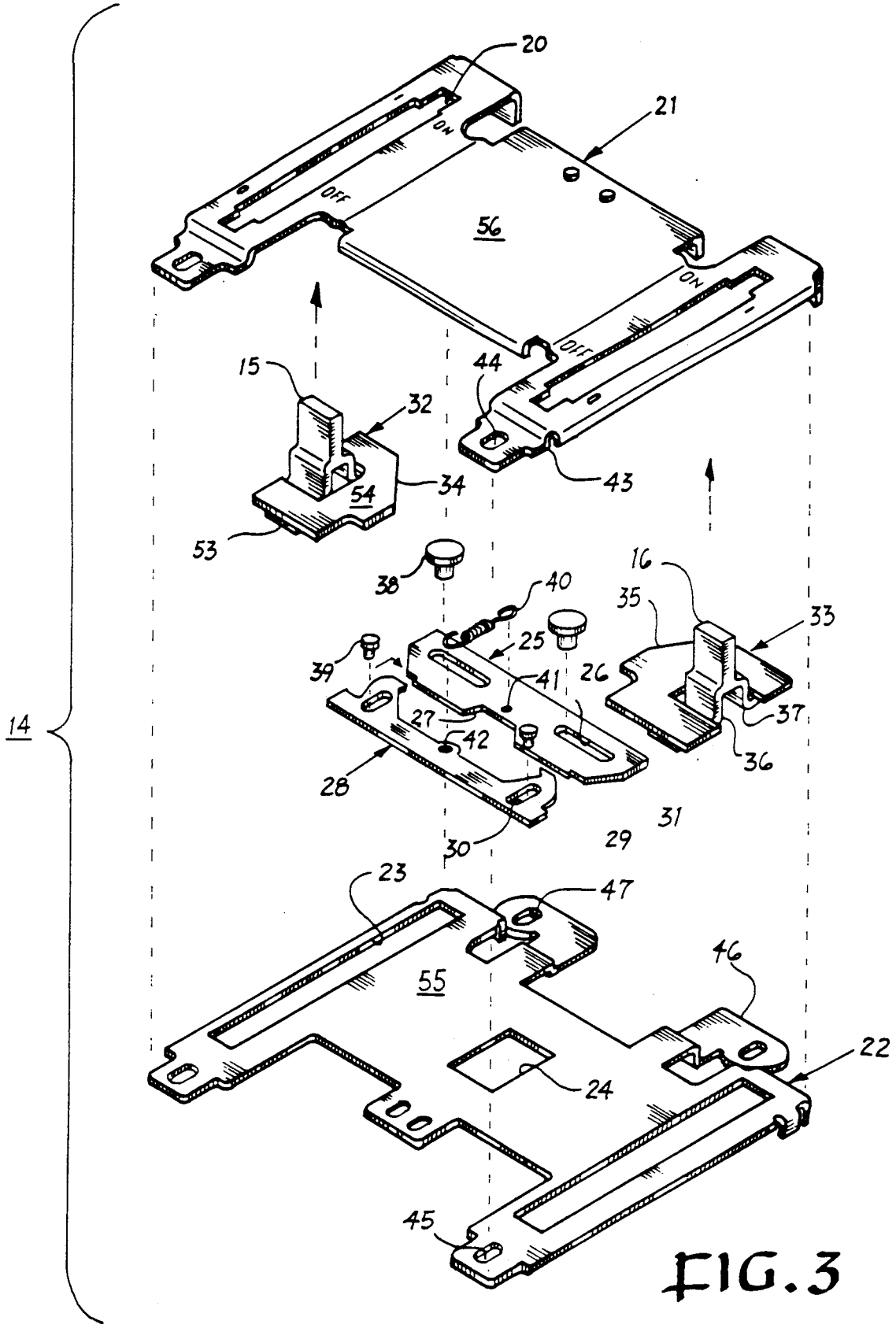
FIG. 3 is a top perspective view in isometric projection of the components used within the bi-stable interlock arrangement of FIGS. 1 and 2.

The assembly of the interlock 14 is best seen by referring now to FIG. 3 wherein the planar base 22 is depicted as formed from a single metal stamping and includes a pair of elongated slots 23 on opposing sides with thru-holes 45 and radial extensions 46 with thru-holes 47 for attachment to an electrical enclosure substrate. A rectangular slot 24 formed within the base provides access to the interior of the interlock for inspection and lubrication purposes. The planar cover 21 is also formed from a single metal stamping and includes a pair of stepped ends 43 which include thru-holes 44 that align with the thru-holes 45 in the base for attachment purposes. A similar pair of elongated slots 20 are formed on the opposing sides of the cover which correspond to the elongated slots 23 formed within the base. A pair of left and right cams 32, 33 and an intervening interlock cam 25 such as described in the aforementioned U.S. Pat. No. 4,924,041 are positioned on the base such that the bottom extension 53 sits within the elongated slot 23 and the top surface 54 of the cam partially overlaps the corresponding top surface 55 of the base. When the cover is later attached to the base, the top surface 54 of the cam is trapped between the top surface of the base 55 and the underside of the top surface 56 of the cover. The interlock handles 15, 16 extend upward through the elongated slots 20 in the cover. As also described in the aforementioned U.S. Pat. No. 4,924,041, the left cam slanted edge 34 and the right cam slanted edge 35 interact with the slanted edges 31 formed on the opposite sides of the interlock cam 25 to prevent one cam from being moved to the ON position when the opposite cam is already in the ON position. The interlock cam 25 includes a pair of slots 26 that are guided by a pair of large shoulder rivets 38 arranged through the slots and through the base that allow the interlock cam 25 to reciprocate in a transverse direction on the base 22 as indicated by the directional arrow. The interlock differs from that described within the aforementioned U.S. Pat. No. 4,924,041 by the addition of a bi-stable latch 28 that include a pair of projections 29, which projections each include a corresponding slot 30. The bi-stable latch 28 is positioned on the base 22 by the insertion of a pair of small shoulder rivets 39 through the slots 30 and through the base. The bi-stable latch 28 interconnects with the interlock cam 25 by means of a small expansion spring-40 which attaches to the interlock cam and bi-stable latch by means of corresponding thru-holes 41, 42. Clearance between the interlock cam and the bi-stable latch for movement of the spring is provided by means of the U-shaped slot 27.

Figure 4A:
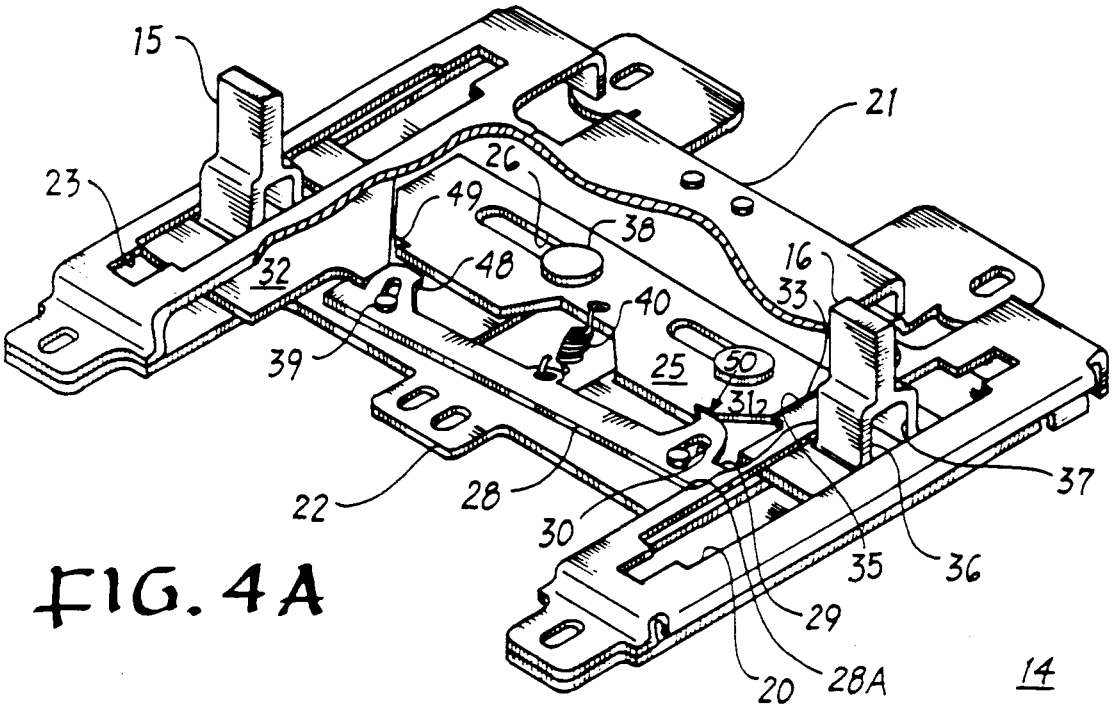
FIGS. 4A and 4B are top perspective views depicting the bi-stable interlock arrangement of the invention with first and second handles interlocked to their ON and OFF positions respectively.
Figure 4B:
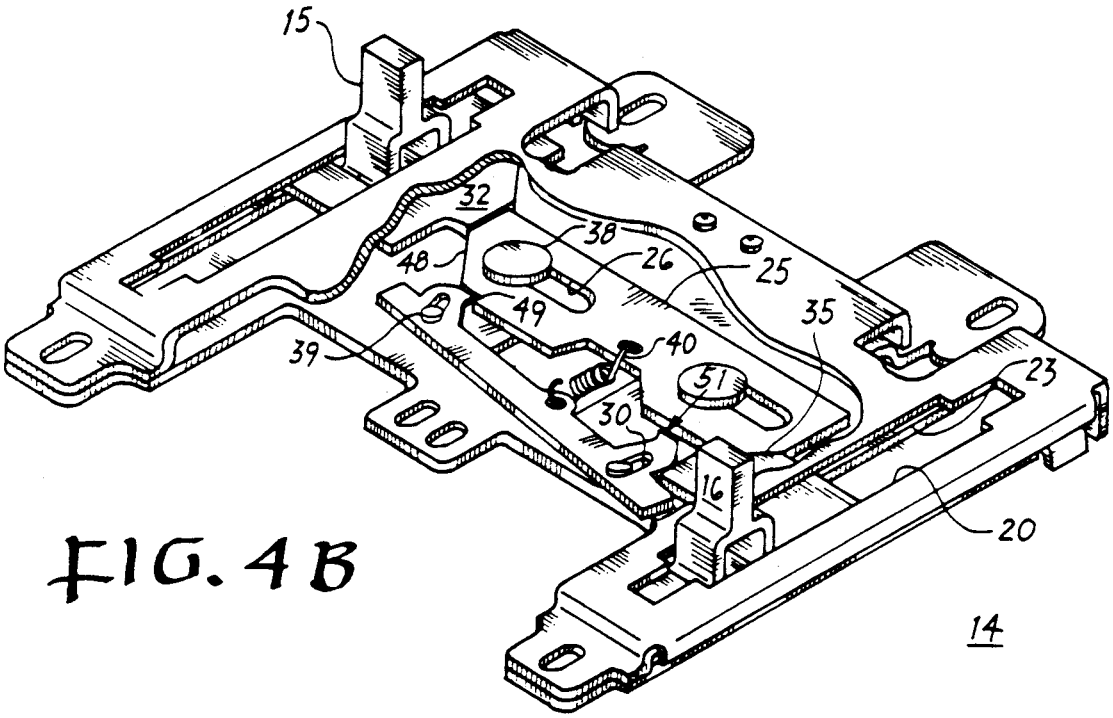

The operation of the interlock 14 is best seen by referring now to FIGS. 4A and 4B wherein a part of the cover 21 is removed to show the interaction between the interlock handles 15, 16 and the corresponding left and right cams 32, 33. In FIG. 4A, the interlock handle 16 is depicted in the ON position and the interlock handle 15 is depicted in the OFF position. The interlock cam 25 is extended horizontally to the left of the shoulder rivets 38 such that the edge of the interlock cam abuts the right hand cam 33. A circuit breaker operating handle when positioned within the U-shaped opening 37 formed within the U-shaped post 36 would be in the ON position and the interlock handle 16 would be uppermost within the elongated slots 20, 23 formed in the cover 21 and base 22. In order to turn the interlock handle 16 to its OFF position, the left cam 32 would have to pass the. slanted edge 31 of the interlock cam 25. The function of the bi-stable latch 28 is to prevent the transverse motion of the interlock cam 25 out of the path of the left cam 32. This is accomplished by means of angular notches 48 formed within the projections 29 on the bi-stable latch and corresponding angular notches 49 formed on the ends of the interlock cam 25. The notches on the bi-stable latch and interlock cam are depicted in their engaged position at 50 with the bi-stable latch 28 rotated counterclockwise as viewed in FIG. 4A. The small shoulder rivet 39 to the right of the expansion spring 40 is at the bottom-most part of the slot 30. The small rivet 39 to the left of the expansion spring 40 is at the uppermost part of the slot 30. Engagement between the angular notches 48, 49 prevents the transfer of the interlock cam 25 in the opposite direction and hence locks the interlock cam in the indicated position. In order for the interlock handle 15 to move to the ON position shown in FIG. 4B, the interlock handle 16 must first be fully moved to the OFF position. Moving the interlock handle 16 to the OFF position drives the right cam 33 down along the corresponding edge of the interlock cam 25 until the slanted edge 35 of the right cam contacts the right end 28A of the bi-stable latch 28 causing the bi-stable latch to rotate clockwise about the end of the expansion spring 40 and drive the angular notch 48 on the projection 29 out of engagement with the angular notch 49 on the end of the interlock cam 25. The rotation of the bi-stable latch 28 in the clockwise direction as viewed in FIG. 4B, about the end of the expansion spring 40 thereby allows the interlock cam 25 to move to the opposite end of the slot 26 out of the path of the left cam 32 which allows the interlock handle 15 to now be moved to the ON position. It is noted that the handle 15 remains in the OFF position until the interlock handle 16 has moved close to the end of the slots 20, 23 which assures that the handle 15 cannot be moved to the ON position until the associated circuit breaker handle, moving in unison with the interlock handle 16, is fully in the OFF position. To return the interlock handle 16 to the ON position, the interlock handle 15 must move to its OFF position to separate the angular notches 48, 49 as described earlier with reference to FIG. 4A.

A "tease"-free bi-stable interlock device has herein been described whereby one handle of an interlocked circuit breaker or safety switch is fully turned to its OFF position before the handle of the other circuit breaker or disconnect switch can be moved to the ON position.

Having thus described our invention, what we claim as new and desire to secure by Letters Patent is:

1. An interlock device for electric circuit breakers and switches comprising in combination:

a planar metal base having first elongated slots arranged on opposite sides thereof;

a planar metal cover on said base having second elongated slots arranged on opposite sides thereof over said first slots;

first and second interlock handles arranged for travel within said first and second slots;

first and second cams attached to said interlock handles, said first and second cams including first and second angulated sides;

an interlock cam on said base extending between said first and second cams, said interlock cam including angulated ends interacting with said angulated sides to allow only one of said first and second cams and attached interlock handle to move in one direction at any one time; and means on said base interacting with said interlock cam to prevent said one of said cams and attached interlock handle from moving in said one direction until the other of said cams has already moved a predetermined distance in an opposite direction.

2. The interlock of claim 1 wherein said means interacting with said interlock cam comprises a bi-stable latch.

3. The interlock of claim 1 including U-shaped posts on said actuator handles arranged for capturing circuit breaker handles and causing said circuit breaker handles to move in unison with said actuator handles.

4. The interlock of claim 1 including interlock cam slots formed within said interlock cam and first shoulder rivets located within said interlock cam slots to guide said interlock cam upon movement within said interlock cam slots.

5. The interlock of claim 2 including an expansion spring connecting between said interlock cam and said bi-stable latch to bias said bi-stable latch in first and second positions.

6. The interlock of claim 2 wherein said bi-stable latch comprises a flat bar pivotally-arranged on said base and including first and second projections and first and second projection slots formed therein.

7. The interlock of claim 5 including second shoulder rivets located within said projection slots to guide said bi-stable latch upon movement within said projection slots.

8. The interlock of claim 6 including first angular notches formed on an outer perimeter of said first and second projections.

9. The interlock of claim 8 including second angular notches formed in opposite edges of said interlock cam, said first angular notches interacting with said second angular notches to thereby prevent said interlock cam from moving away from said first and second cams.

10. The interlock of claim 7 including a clearance slot formed in said bi-stable latch intermediate said first and second projections, said clearance slot providing clearance for attachment of and pivotal movement of said expansion spring.

* * * * *